US009433248B2

(12) United States Patent
Bellak

(10) Patent No.: US 9,433,248 B2
(45) Date of Patent: Sep. 6, 2016

(54) PROTECTIVE CLOTHING TO KEEP A USER CLEAN WHEN USING YARD CARE POWER TOOLS

(71) Applicant: Michael L. Bellak, Coventry Township, OH (US)

(72) Inventor: Michael L. Bellak, Coventry Township, OH (US)

(73) Assignee: Michael L. Bellak, Akron, OH (US)

( * ) Notice: Subject to any disclaimer, the term of this patent is extended or adjusted under 35 U.S.C. 154(b) by 0 days.

(21) Appl. No.: 14/685,896

(22) Filed: Apr. 14, 2015

(65) Prior Publication Data

US 2015/0289574 A1 Oct. 15, 2015

Related U.S. Application Data

(60) Provisional application No. 61/979,635, filed on Apr. 15, 2014.

(51) Int. Cl.
*A41D 17/00* (2006.01)
*A41D 17/02* (2006.01)

(52) U.S. Cl.
CPC ..... *A41D 17/005* (2013.01); *A41D 17/00* (2013.01); *A41D 17/02* (2013.01)

(58) Field of Classification Search
CPC ..... A41D 17/005; A41D 17/02; A41D 3/06; A41D 13/0543; A41D 13/0556; A41D 13/0562; A41D 17/04; A41D 17/00; A41D 1/14; A41D 13/06; A41D 13/065; A41D 13/055; A41D 2600/20
USPC ..... 2/232, 22, 23, 62, 309, 311
See application file for complete search history.

(56) References Cited

U.S. PATENT DOCUMENTS

| | | | | |
|---|---|---|---|---|
| 34,221 | A | 1/1862 | Steere | |
| 5,014,636 | A * | 5/1991 | Seber | A41D 13/0012 112/419 |
| 5,031,247 | A | 7/1991 | Carter | |
| D376,253 | S * | 12/1996 | Johansson | D2/901 |
| 5,815,948 | A | 10/1998 | Dzielak | |

(Continued)

FOREIGN PATENT DOCUMENTS

DE WO 2012126551 A1 * 9/2012 ..... A41D 1/06

OTHER PUBLICATIONS

Translation of WO 2012126551, Kuehl, Kai-Uwe, Item of Clothing Having a Device for Protection Against Pests, In Particular Ticks, Sep. 27, 2012.*

*Primary Examiner* — Anna Kinsaul
*Assistant Examiner* — Heather Mangine
(74) *Attorney, Agent, or Firm* — Eschweiler & Associates, LLC

(57) ABSTRACT

The present invention comprises a protective covering for keeping a user's leg clean while using power tools such as grass and weed trimmers or sprayers for various paints, stains and chemicals. The protective covering comprises a washable yet moisture resistant fabric. The V notch at the upper end allows for easily pulling the protective covering over user's pants and shoes, also leaving a slight opening for breathability. Fabric is flared at the lower end to protect user's shoes. Protective cover is held in place on the user's leg by a combination of hook and loop fastener and elastic strip attached at the upper end; this combination of hook and loop fastener and elastic strip allows protective cover to be attached above user's knee and to fit comfortably and snuggly as user moves about with the grass and weed trimmer. Preferably, the protective cover comprises a substantially conical, nonwoven polypropylene fabric.

9 Claims, 2 Drawing Sheets

(56) References Cited

U.S. PATENT DOCUMENTS 6,199,217 B1 3/2001 Mooney
6,205,593 B1 3/2001 Schaub, Jr.
6,301,803 B1 * 10/2001 Patterson ..... A41D 17/00 36/1.5
7,552,483 B2 * 6/2009 Turner ..... A41B 11/125 2/239
8,161,573 B1 * 4/2012 Burns-Cox ..... A41D 13/1245 2/227
8,181,280 B2 * 5/2012 Caliste ..... A41D 13/1254 2/400

* cited by examiner

PROTECTIVE CLOTHING TO KEEP A USER CLEAN WHEN USING YARD CARE POWER TOOLS

REFERENCE TO RELATED APPLICATION

This application claims priority to U.S. Provisional Application No. 61/979,635 filed on Apr. 15, 2014, the contents of which are incorporated by reference in their entirety.

TECHNICAL FIELD

The present invention generally relates to protective clothing for use with yard care power tools such as grass and weed trimmers, chainsaws, and sprayers.

BACKGROUND OF THE INVENTION

Hand held grass and weed trimmers, using a rotating filament or a plastic rod to accomplish the trimming, are used widely in lawn maintenance. The trimmers generally are characterized by an elongated body in the form of a narrow shaft having forward and rear ends. A spool of cutting filament or a series of plastic rods generally are mounted at the forward end of the trimmer and a length of filament is unwound from the spool so as to perform the cutting action as the spool is rotated at high speeds. Although the trimmer is typically equipped with a shield at the forward end of the trimmer near the cutting filament, the shield is only marginally effective. As the trimmer operates, grass and weed clippings will reach the user, leaving the user covered in grass, weeds, and other small debris. This will leave the user dirty and oftentimes feeling sticky and uncomfortable and his clothing dirty and oftentimes stained. Depending upon the flora the user is working in, he can also get covered with residues from noxious plants such as poison ivy oil and painful briars which could leave the user in need of medical treatment.

Though there are many protective coverings available to protect the user of a hand held weed and grass trimmer, they are primarily concerned with protecting the user from injury due to impact from flying debris such as stones and twigs. As such, they are not comfortable to wear nor are they purposed to keep the wearer and his clothing clean and dry. Schaub (U.S. Pat. No. 6,205,593) attempts to provide a protective covering. While providing a protective covering, the covering Schaub teaches is designed to provide a leg protector which when subjected to a repetitive impact absorbs the impact of flying debris. Schaub does not teach a protector which provides protection of the user's shoes nor does he teach a weather resistant protective covering. The protective covering taught by Schaub uses weights to keep the protective covering from bunching up on the user's legs so it is questionable whether the protective covering is truly lightweight. The protective covering taught by Schaub fits snuggly around the user's upper leg so it is questionable whether the protective covering is truly comfortable.

The present invention provides an extremely light weight, breathable, adjustable, comfortable, and cleanable covering for the operator of a hand held weed and grass trimmer or sprayer.

BRIEF SUMMARY OF THE INVENTION

The present invention comprises a protective covering for a user's leg while using a hand held grass and weed trimmer or other yard care power tool such as a chainsaw, a pressure washer, bug sprayer, power painter, and the like. The protective covering provides protection from dirt and grime to a user's leg from the lower portion of the upper leg down to the top of the user's shoes; effectively keeping the user's legs and clothing clean while using the hand held grass and weed trimmer. The protective covering comprises a readily washable and moisture resistant fabric. The fabric is notched with a V notch at the upper end which allows for easily pulling the protective covering over the user's pants and shoes. The fabric is flared at the lower end to protect the user's shoes. At the lower end, the fabric also arcs upwards towards the back of the user's shoes which improves the durability of the protective covering by reducing the opportunity for the protective covering to slip below the user's shoe while protecting the user's shoes. The protective cover is held in place on the user's leg by a combination of hook and loop fastener (such as VELCRO) and elastic strip attached at the protective cover's upper end; this combination of hook and loop fastener and elastic strip allows the protective cover to be attached above the user's knee and to fit comfortably and snuggly as the user moves about with the grass and weed trimmer. Preferably, the protective cover comprises a substantially conical, nonwoven polypropylene fabric. Due to the simplicity of the protective cover, it can be manufactured economically.

The invention, and its objects and advantages, will become more apparent in the detailed description of the preferred embodiment presented below.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings, relative proportions depicted or indicated of the various elements of which disclosed members are comprised may not be representative of the actual proportions, and some of the dimensions may be selectively exaggerated.

DETAILED DESCRIPTION OF THE INVENTION

Various embodiments of the present invention provide a protective covering for the leg of a person operating a hand held grass/weed trimmer or similar power tools and sprayers.

Figure 1:
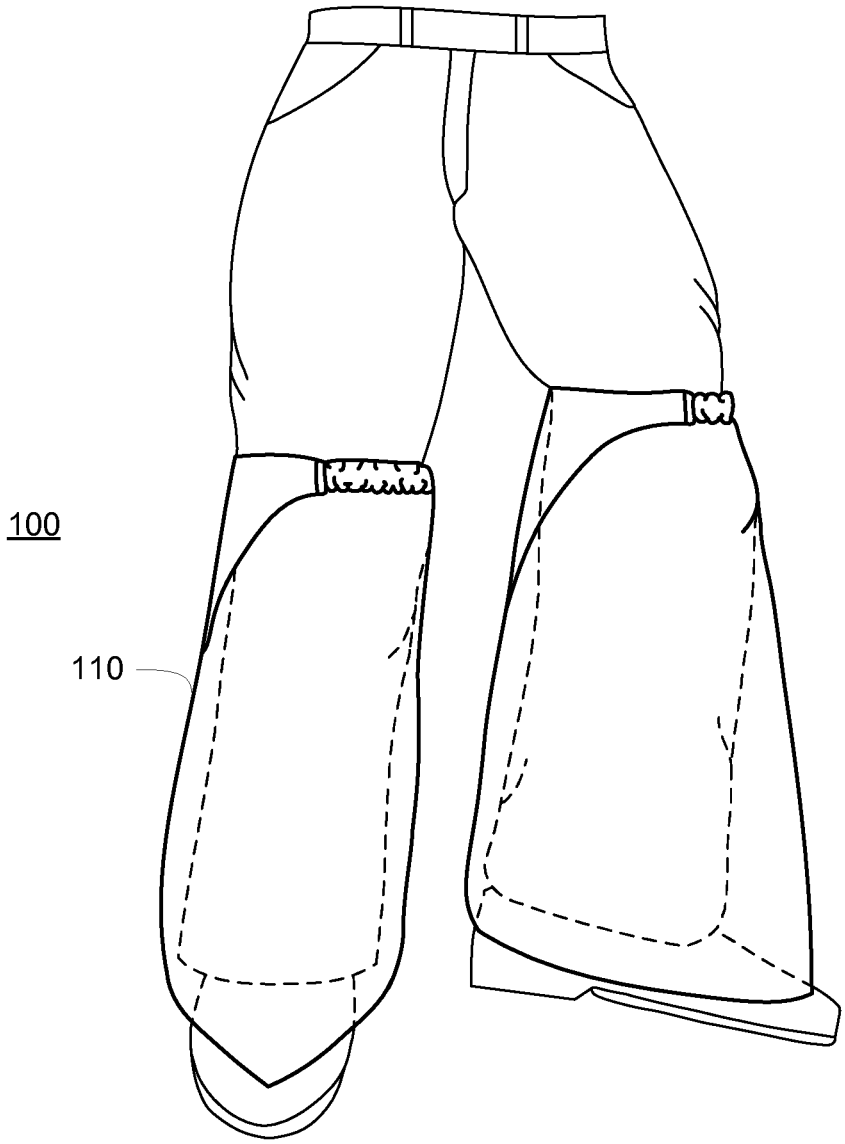
FIG. 1 illustrates a set of protective covers of the present invention in use.

Referring to FIG. 1, a person wearing a preferred embodiment of a protective covering 100 of the present invention is depicted. The protective covering 100 comprises a lightweight, flexible, breathable, water resistant fabric formed into a substantially conical body 110. In the preferred embodiment, the lightweight, flexible, breathable fabric is comprised of 100 percent polypropylene. In one preferred embodiment of the present invention, the polypropylene comprises a nonwoven polypropylene which has a fabric weight of between about 60 grams per square meter and about 120 grams per square meter. The polypropylene more preferably comprises a nonwoven polypropylene which has a fabric weight of about 80 grams per square meter. The protective covering 100 may also be comprised of a polypropylene polyethylene fabric, a polypropylene polybutylene fabric and the like.

Figure 2:
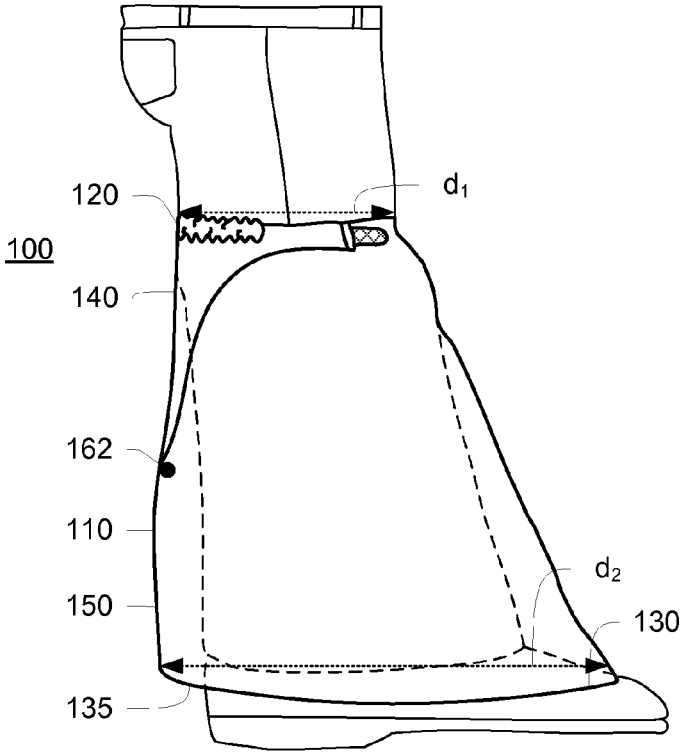
FIG. 2 illustrates a side elevation view of an embodiment of a protective cover.

Referring to FIG. 2, a side view of a preferred embodiment of the protective covering 100 is depicted. The substantially conical body 110 possesses a height 140 and an upper end 120 and a lower end 130. The upper end 120 is narrower than the lower end 130. In one preferred embodiment, a diameter d1 of the upper end 120 is preferably between about 6 inches and 8 inches, and more preferably about 8 inches. A diameter d2 of the lower end 130 is preferably between about 8 inches and 12 inches and more preferably about 10 inches. The height 140 of the substantially conical body 110 will preferably be between about 22 inches and 26 inches and more preferably about 24 inches for use by a male wearer with a height of between about 5 feet 10 inches and about 6 feet 4 inches. The height 140 of the substantially conical body 110 will preferably be between about 20 inches and 24 inches and more preferably about 21 inches for use by a male wearer with a height of between about 5 feet 2 inches and about 5 feet 10 inches. For users with heights outside these ranges, the dimensions of the substantially conical body 110 will be proportionally adjusted to fit the user. The substantially conical body 110 is preferably formed via a rearward hem 150 along the back of the protective covering 100.

Figure 3:
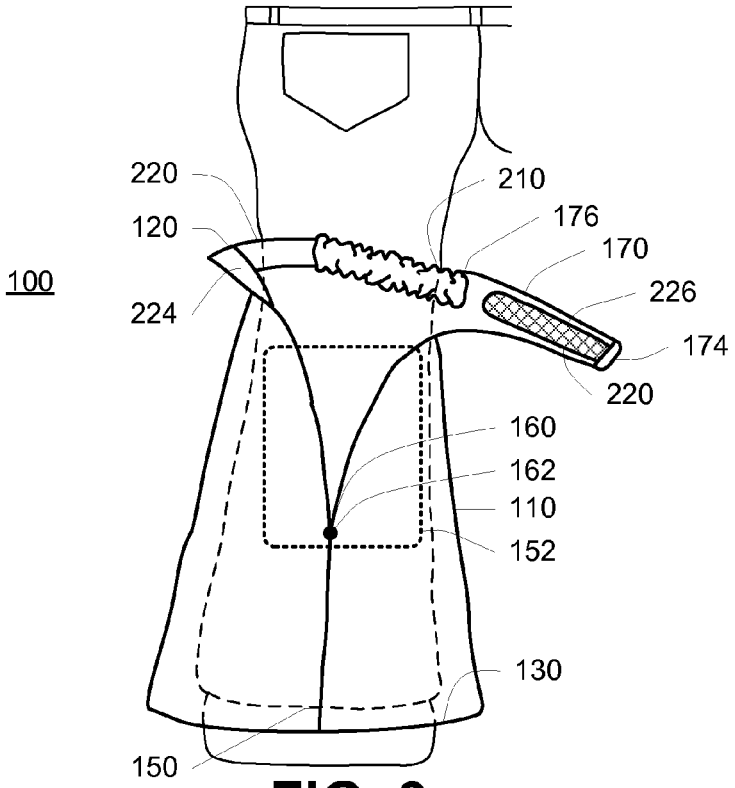
FIG. 3 illustrates a rearward elevation view of an embodiment of a protective cover.

Referring to FIG. 3, a rearward view of a preferred embodiment of the protective covering 100 is depicted. The rearward hem 150 of the substantially conical body 110 runs from the lower end 130 to a hem endpoint 160 below the upper end 120. The distance from the hem endpoint 160 and the upper end 120 is preferably about 12 inches to about 16 inches, and is more preferably about 14 inches when designed for use by a person with a height of about 5 feet 10 inches to about 6 feet. For users with heights outside these ranges, the dimensions of the substantially conical body 110 will be proportionally adjusted to fit the user. The substantially conical body 110 is preferably formed via a rearward hem 150 along the back of the protective covering 100. This will allow for the protective covering 100 to have a "V" notch opening 152 when the user pulls the protective covering 100 on or off. The V notch opening 152 allows for ease in pulling the protective covering 100 over the user's shoe.

A rivet 162 is installed approximate to the hem endpoint 160 to provide additional support to the stress point of the rearward hem 150. The rivet 162 makes sure the rearward hem 150 is not ripped off, in situations such as, for e.g., when the user accidently steps on and pushes the V notch opening 152 etc.

Referring again to FIG. 3, there is a tab 170 possessing a lead end 174 and a tail end 176 extending from the upper end 120. The tab 170 is preferably about three to twelve inches long and about 1.5 inches wide. The tab 170 is more preferably about 4.5 inches long. In the preferred embodiment, the tab widens to about 3 inches wide along a length of the V notch opening 152. This widening of the tab 170 as it approaches the substantially conical body 110 provides strength to the tab 170 and reduces the possibility of the tab 170 from ripping away from the substantially conical body 110.

Referring again to FIG. 3, affixed to the upper end 120 is an elastic strip 210 and a hook and loop fastener 220. The elastic strip 210 is preferably affixed to the upper end 120 near the tail end 176 of the tab 170. The length of the elastic strip 210 is preferably about six inches to thirteen inches in length and more preferably about ten inches in length. The hook and loop fastener 220 is comprised of a hook pad 224 and a loop pad 226. The loop pad 226 is preferentially attached substantially to the length of the tab 170. The hook pad 224 is preferably affixed to the upper end 120 near the elastic strip 210. The hook pad 224 is preferably about four inches to about six inches in length. The hook and loop fastener 220 allows for the protective covering 100 to fit comfortably to the user's leg. The elastic strip 210 allows for the protective covering 100 to fit snuggly to the user's leg and remain secured as the user moves and the leg changes diameter as the user's muscles contract and expand. The loop pad 224 is preferably attached to the tab 170 to keep the tab 170 from picking up loose debris when the protective covering 100 is not in use. The tab 170 covers portions of the V notch opening 152 when the hook and loop fastener 220 is in fastened position yet designed to leave a slight opening for airflow and breathability.

The elastic strip 210 and hook and loop fastener 220 are preferably attached to the upper end 120 via sewing. Other readily available means to attach the elastic strip 210 and hook and loop fastener 220 such as gluing or riveting may also be used. Other readily available means to attach the protective covering to the user's leg such as using a series of buttons and button eyelets, clip fasteners, tie strings, magnets, etc. may also be used. Thus, in somewhat general terms, the protective covering includes a first fastening element attached to the upper end 120 on a first side of the V-shaped notch 152, and a second fastening element attached to the upper end 120 on a second side of the V -shaped notch 152. The first and second fastening elements cooperatively work together to allow a user to easily open the V -shaped notch, slide his or her foot through the protective covering so the protective covering covers his or her leg, then engage the first and second fastening elements to close the V-shaped notch. Thus, the second fastening element is configured to detachably engage the first fastening element to selectively set a diametric opening size for the upper end 120 of the substantially conical body 110.

In the preferred embodiment, the protective covering 100 comprises a continuous sheet of fabric extending from the upper end 120 to the lower end 130 that includes only hems to provide the desired shape. The protective covering 100 does not include any weights or structural ribs, and that allows it to be a light weight, breathable, and comfortable covering. Further, this simplicity of the protective covering 100, also allows it to be manufactured economically.

Referring again to FIG. 2, it is readily apparent that the lower end 130 follows a gently sloping arc 135. The gently sloping arc 135 allows for the protective covering 100 to rest above the user's shoes and improves the durability of the protective covering by reducing the opportunity for the protective covering to slip below the user's shoe while still providing protection from debris to the user's shoes.

The invention has been described in detail with particular reference to certain preferred embodiments thereof, but it will be understood that variations and modifications can be effected within the spirit and scope of the invention.

What is claimed is:

1. A protective leg covering comprising:

a substantially conical body of fabric having a lower portion and an upper portion that meet at a medial point disposed on a rearward side of the substantially conical body, wherein a height of the substantially conical body ranges between 20 inches and 26 inches; wherein the lower portion is substantially tubular and extends downwardly from the medial point to a lower edge of the substantially conical body, the lower edge having a fixed perimeter and defining only one lower end opening in the substantially conical body, wherein a diameter of the lower end opening ranges between 8 inches and 12 inches; wherein the upper portion has a height that ranges between 12 inches and 16 inches and comprises a first flap and a second flap with respective first and second edges on opposite sides of a leg-hole, wherein the first and second edges extend upwardly from the medial point and are adjoined to one another by an elastic strip partially surrounding the leg-hole;

a rearward hem disposed on the rearward side and extending from the lower end opening to a hem endpoint, wherein the hem endpoint corresponds to the medial point;

a rivet installed proximate to the hem endpoint;

a first fastening element disposed on the first flap, wherein a length of the first fastening element ranges between 4 inches and 6 inches;

a second fastening element disposed on a tab protruding from the second flap, wherein a length of the tab ranges between 3 inches and 12 inches and a width of the tab is 1.5 inches;

wherein the first fastening element is configured to selectively engage the second fastening element such that, when the first and second fastening elements are unengaged, the leg-hole has a first perimeter corresponding to the lengths of the first and second edges plus a length of the elastic strip, but when the first and second fastening elements are engaged, the first flap overlaps the second flap to form a substantially tubular upper sidewall extending upwardly from the medial point to an upper edge of the upper portion, wherein when the first and second fastening elements are engaged the leg-hole has a second perimeter corresponding to the length of the elastic strip but not the lengths of the first and second edges.

2. The protective covering recited in claim 1, wherein the upper end opening includes a V-shaped notch terminating at the hem endpoint.

3. The protective covering recited in claim 1, wherein the fabric is flared at the lower end.

4. The protective covering recited in claim 2, wherein the width of the tab, increases along a length of the V -shaped notch.

5. The protective covering recited in claim 1, wherein a hook and loop fastener is attached to the upper portion via sewing, gluing or riveting.

6. The protective covering recited in claim 1, wherein a diameter of the lower end opening is greater than a diameter of the upper end opening.

7. The protective covering recited in claim 1, wherein a length of the elastic strip ranges between approximately 6 inches and approximately 13 inches.

8. The protective covering recited in claim 1, wherein a weight of the fabric, ranges between approximately 60 grams per square meter and approximately 120 grams per square meter.

9. The protective covering recited in claim 1, wherein the fabric is comprised of 100 percent polypropylene.

* * * * *